US008066263B1

(12) United States Patent
Soderlund

(10) Patent No.: US 8,066,263 B1
(45) Date of Patent: Nov. 29, 2011

(54) ROTARY DISK HUMIDIFIER

(75) Inventor: Ernest E. Soderlund, Montgomery, IL (US)

(73) Assignee: Braeburn Systems, LLC, Montgomery, IL (US)

( * ) Notice: Subject to any disclaimer, the term of this patent is extended or adjusted under 35 U.S.C. 154(b) by 889 days.

(21) Appl. No.: 12/080,449

(22) Filed: Apr. 2, 2008

(51) Int. Cl.
*B01D 3/04* (2006.01)

(52) U.S. Cl. ..... 261/92; 261/DIG. 34

(58) Field of Classification Search ..... 261/83, 261/92, 119.1, DIG. 15, DIG. 34
See application file for complete search history.

(56) References Cited

U.S. PATENT DOCUMENTS

| | | | | |
|---|---|---|---|---|
| 2,060,636 | A | 11/1936 | Persons | |
| 2,054,039 | A | 9/1938 | Persons | |
| 2,253,418 | A | 8/1941 | Crandall et al. | |
| 2,703,228 | A * | 3/1955 | Fleisher | 96/235 |
| 3,309,021 | A * | 3/1967 | Powers | 237/78 R |
| 3,385,574 | A * | 5/1968 | Lohman | 261/92 |
| 3,481,588 | A | 12/1969 | Lobb | |
| 3,705,479 | A | 12/1972 | McPherson | |
| 3,724,824 | A | 4/1973 | Mitich | |
| 3,733,062 | A * | 5/1973 | Bracich | 261/92 |
| 3,774,588 | A | 11/1973 | Yeagle | |
| 3,799,517 | A * | 3/1974 | Tamm | 261/128 |
| 3,823,922 | A | 7/1974 | McElreath | |
| 4,036,597 | A | 7/1977 | Filss | |
| 4,056,582 | A | 11/1977 | Chow | |
| 4,185,687 | A | 1/1980 | Stockman | |
| 4,399,031 | A | 8/1983 | Imano et al. | |
| 5,171,486 | A | 12/1992 | Penno | |
| 5,795,505 | A * | 8/1998 | Burns | 261/92 |

* cited by examiner

*Primary Examiner* — Frank Lawrence, Jr.
(74) *Attorney, Agent, or Firm* — Greenberg Traurig LLP

(57) ABSTRACT

A rotary disk humidifier of the type that has multiple parallel spaced disks rotatably mounted in a water reservoir in a housing with controls for maintaining the water level in the housing to obtain an optimum wetted disk area above the water level exposed to air flow to achieve optimum humidification. At one theoretical extreme, the water level is at or above the center of rotation of disks decreasing the area of the disks exposed to free air flow through the housing. At the other theoretical extreme with the water level just at or slightly above the outer diameter of the disks, there is a grossly insufficient wetted area of the disk to approach the optimum area. Between those extremes there is a mathematical optimal range of the ratio inner wetted diameter of the disk $R_i$ to the outside wetted diameter of the disk $R_o$ (or the average outer diameter of the disk—the disk may not be circular) of about 0.30.

24 Claims, 5 Drawing Sheets

ROTARY DISK HUMIDIFIER

BACKGROUND OF THE INVENTION

Rotary disk humidifiers have been commercially available for decades. They generally include a stack of flat circular disks that are mounted closely spaced and parallel to one another on a central shaft that rotates and immersed in a water reservoir so that as the disks rotate through the water bath, air flows across the disks above the water bath entraining water vapor in the air stream and thereby humidifying air exiting from the humidifier.

However, no attempt insofar as the present inventor is aware, has been made to optimize the wetted area of the disks exposed to air flowing through or across the disks.

For example, in the Burns, U.S. Pat. No. 5,795,505, a humidifier is disclosed with a spaced stack of annular disks rotated through a water bath with an axial flow inlet 44 that drives air axially through the center of the disks, which air is blocked by a plate 26 to cause the air to turn radially across the disks. No attempt or discussion is contained in the Burns patent relating to optimizing the wetted area of the stacked disks 10.

The Persons, U.S. Pat. No. 2,054,039, shows an axial to radial flow air conditioning system in FIG. 2A and what appears to be a radial-inlet to radial-outlet system in FIG. 2. But again, no attempt is made by Persons to optimize the wetted area of the disks exposed to air. The same is true of the Persons, U.S. Pat. No. 2,060,636.

In the Tamm, U.S. Pat. No. 3,799,517, a method for moistening air is disclosed including a plurality of stacked disks rotatable in a reservoir with water illustrated in FIG. 2, with the water level shown at FIG. 9. This is an extremely low water level and provides a very narrow wetted area of the disks above the water level.

The deficiency in Tamm is also shown in the McElreath, U.S. Pat. No. 3,823,922, relating to a humidifier, and this system makes no attempt to optimize the wetted area of the disks.

The Filss, U.S. Pat. No. 4,036,597, shows a plurality of circular plates but the system is designed not for humidification, but for purifying gasses, and therefore, is not relevant to the present invention.

It is a primary object of the present invention to ameliorate the problems noted above in the prior art and to optimize the wetted area $A_{we}$ of humidifier disk stacks in a humidifier.

SUMMARY OF THE PRESENT INVENTION

In accordance with the present invention, a rotary disk humidifier is provided that has multiple parallel spaced disks rotatably mounted in a water reservoir in a housing with controls for maintaining the water level in the housing to obtain an optimum wetted disk area above the water level exposed to air flow to achieve optimum humidification. At one theoretical extreme, the water level is at or above the center of rotation of disks decreasing the area of the disks exposed to free air flow through the housing. At the other theoretical extreme with the water level just at or slightly above the outer diameter of the disks, there is a grossly insufficient wetted area of the disk to approach the optimum area. Between those extremes there is a mathematical optimal range of the ratio inner wetted diameter of the disk $R_i$ to the outside diameter of the disk $R_o$ (or the average outer diameter of the disk—the disk may not be circular) is in the range of about 0.30.

In rotary disk humidifier designs, a number of disks typically rotate around a center shaft. Part of the disks are submerged in a water bath, with the remaining part of the disks exposed to an air stream which comes from outside the humidifier. Water evaporates from the disk's surfaces humidifying adjacent air. The humidified air ultimately enters a furnace plenum after passing through the humidifier (FIG. 1).

The humidification capacity of each disk is proportional to the portion of the surface area wetted by the water bath, that is then exposed to the air stream and available for evaporation into the air stream. Any area of the disk that is not wetted by the water bath or is submerged, does not contribute to the humidification capacity (FIG. 2).

The distance from the center of rotation to the water surface can be defined as $R_i$ (the inner diameter of the wetted area on each disk). The outer wetted diameter $R_o$ of each disk is simply the average outer diameter of each disk. It can be shown that for a given disk outer diameter ($R_o$), the wetted surface area (bounded by $R_o$ and $R_i$) can be optimized by keeping the water level at a certain height ($R_i$) with respect to the disk's center of rotation. $R_i$ is also the radius of the wetted segment of the disk (FIG. 3). If the water level is at or below the bottom radius of the disk, none of the disk area is wetted, and there is no water evaporation from the surface (FIG. 4). If the water level is even with the disk centerline, the wetted area is simply half the disk area, $PiR_o^2/2$ (FIG. 5). If the water level is maintained above the centerline of the disk, the wetted area exposed to the air stream is reduced from that in FIG. 5. The wetted area exposed to the air stream will then be between $PiR_o^2/2$ and zero if the water level is at the highest point of the disk.

If the water level is maintained above the bottom edge of the disk, but below the centerline, the wetted area exposed to the air stream can be shown to be equal to the entire area of the disk, minus the area of the disk that is not wetted, minus the wetted area submerged below the waterline (FIG. 3), that is:

$$A_{wetted\ and\ exposed} = \underbrace{(PiR_o^2)}_{\text{Area of Disk}} - \underbrace{(PiR_i^2) - PiR_o^2/2}_{\text{Area Not Wetted}} - \underbrace{R_iR_o\cos[\sin^{-1}(R_i/R_o)] - R_o^2\sin^{-1}(R_i/R_o)}_{\text{Area Submerged}},$$

where $R_o$=the outer radius of the disk, and $R_i$=the distance from the disk center to the water surface of the water.

Normalizing or reducing by dividing through by $R_o^2$ and letting $R_i/R_o$=r, $A/R_o^2$=Pi(½=$r^2$)+r cos($\sin^{-1}$ r)+$\sin^{-1}$ r, showing that for any given disk diameter, the wetted area $A_{we}$ exposed to the air stream is a function of the ratio of the inner to outer diameter. This function does not monotonically increase or decrease between $R_i/R_o$=0 (water line maintained at the center of the disk) and $R_i/R_o$=1/1=1 (water line maintained at the bottom of the disk), and therefore has a maximum wetted area exposed to the air stream. The optimum ratio of the inner to outer diameter is about 0.3, as seen in FIG. 6. This can be shown by solving the above equation numerically (FIG. 6) and corresponds to an optimum wetted area exposed to the air stream about: $^A$max for r=0.3=1.88 $R_o^2$. The maximum at r=0.3 can also be found alternatively, by taking the derivative of the normalized area, so $R_1$ should be about 30% of $R_o$.

$$\frac{d}{dr}(A/R_o^2) =$$

$$0 = -2Pi(r) - r\sin(\sin^{-1}r)(1-r^2)^{-1/2} + \cos(\sin^{-1}r) + (1-r^2)^{1/2} = 0$$

This can be shown by setting the above equal to zero, and solving it numerically (FIG. 6).

Other objects and advantages of the present invention will be more apparent from the following detailed description.

DETAILED DESCRIPTION OF THE PREFERRED EMBODIMENT

Figure 1:
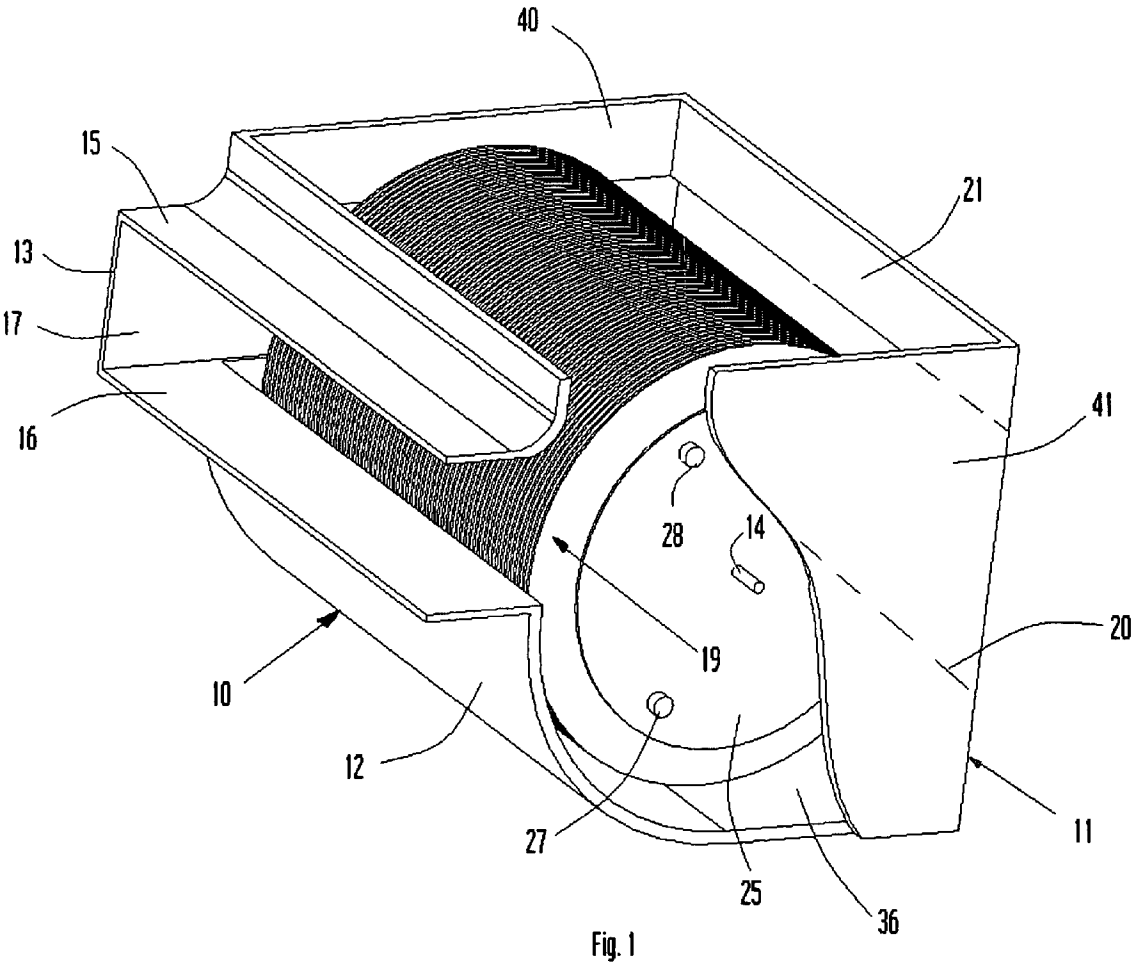
FIG. 1 is a partly broken away perspective view of the present stacked disk humidifier.
Figure 2:
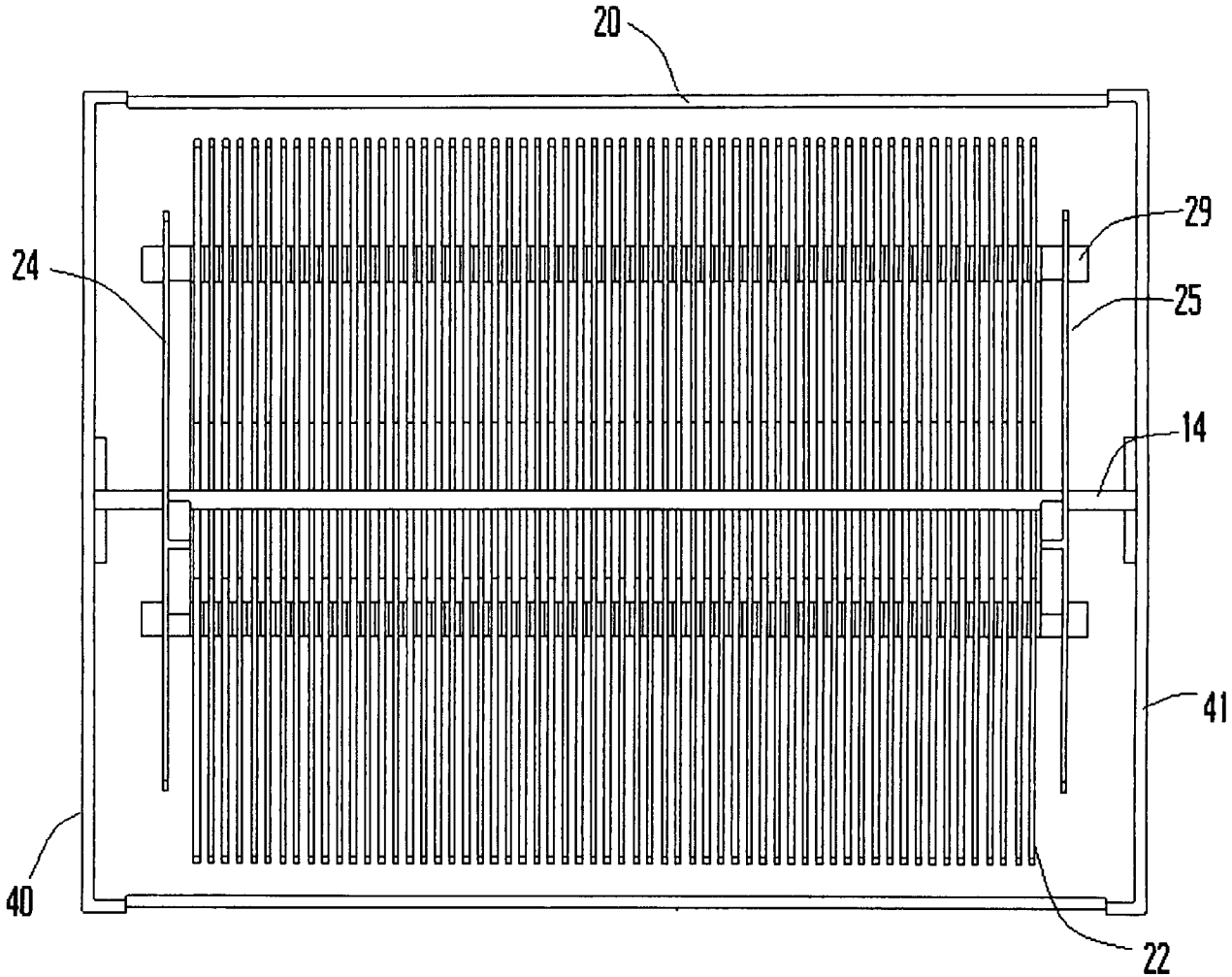
FIG. 2 is a longitudinal cross section of FIG. 1 taken approximately through the center axis of its driving shaft.

Viewing FIGS. 1 and 2, a multiple disk humidifier is illustrated generally designated by the reference numeral 10, and is seen to include a housing 11 consisting of an arcuate front panel 12 having an integral inlet 13 that is formed by top panel 15, bottom panel 16, and end panels 17, which direct air flow radially across disk stack 19 and through outlet opening 20 in rear panel 21 illustrated in dotted lines in FIG. 1.

Figures 3, 4:
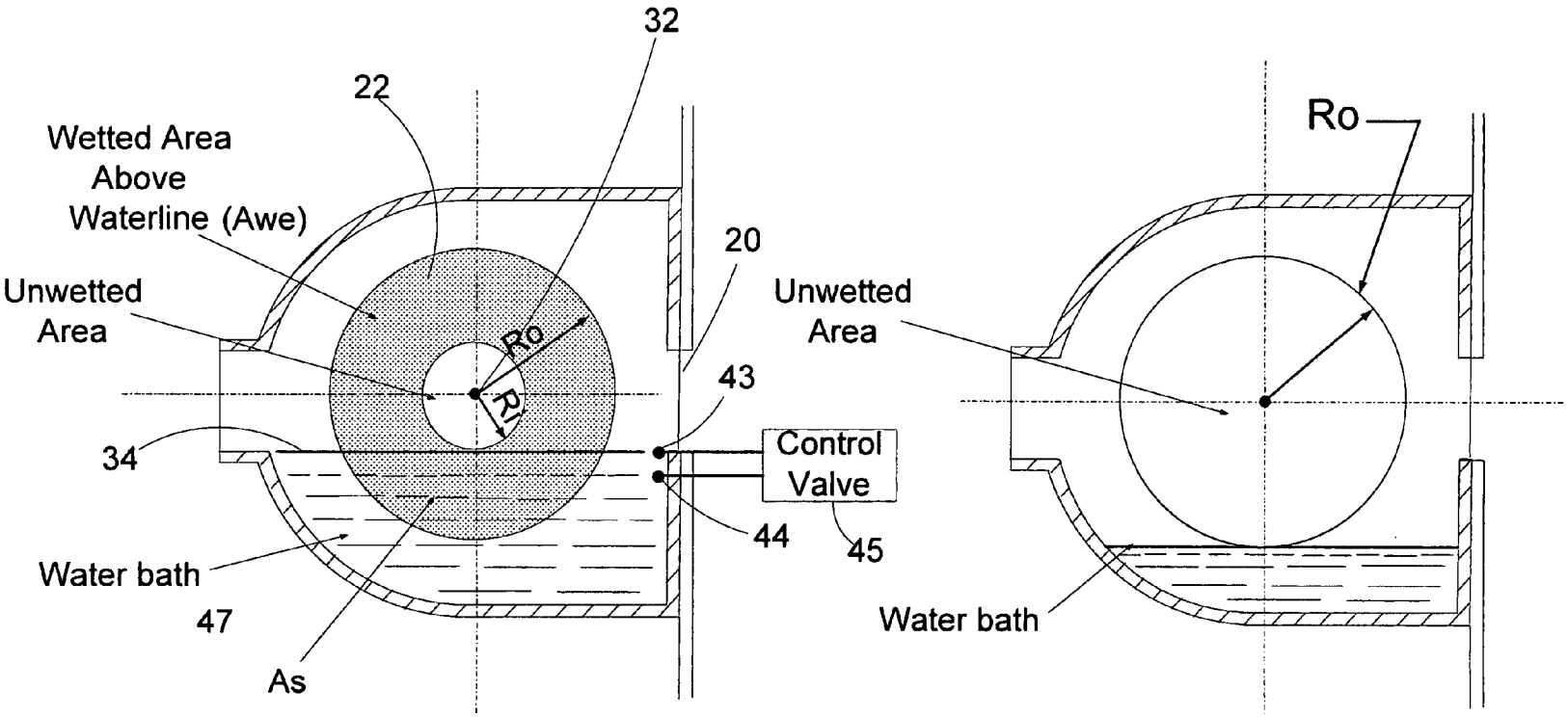
FIG. 3 is a cross section of the humidifier illustrated in FIG. 1 showing an optimal relationship between $R_1$ and $R_o$.
FIG. 4 is a cross section similar to FIG. 3 showing the effects of a low water level.

The disk stack 19 is driven by a motor not illustrated in the drawings and is seen to include a plurality of circular disks 22 closely spaced from one another as illustrated in FIG. 2 in parallel mounted configuration which are held in assembly by end plates 24 and 25 that carry rods 27, 28 and 29 (see both FIGS. 1 and 2) that hold the disks in position. A central shaft 14 keyed through the end plates 24 and 25 drives the disk stack 19 in rotation. As seen in FIG. 3, each of the disks has a radius $R_i$, which is the distance between center rotation 32 and the water surface 34, or more precisely is the inner diameter of the wetted area of the disks 22 as they are exposed to air as the disks 22 rotate. The water bath illustrated in FIG. 3 is contained by reservoir 36 illustrated in FIG. 1, defined by front wall 12 and rear wall 21 and side walls 40 and 41. Switch 43 provides a signal to valve control 45 to maintain the water level at 34 and $R_i$ below that sensor, while sensor 44 provides a signal to valve control 45 to maintain the water level 34 above that sensor.

In FIG. 3, $A_{we}$ designates the wetted area of the disk above the water line; i.e., the wetted area of the disk exposed to air flowing across the disk from inlet 13 to outlet 20. $A_s$ in FIG. 3 designates the area of the disk submerged in the water bath 47. It should be understood that humidified air exiting outlet 20 typically enters a furnace plenum.

The humidification capacity of each disk is proportional to the portion of the surface area wetted by the water bath 47, that is then exposed to the air stream and subsequently available for evaporation into the air stream. Any area of the disk that is not wetted by the water bath or is submerged does not contribute to the humidification capacity.

The purpose of the present invention is to maximize the area $A_{we}$, the wetted area above the water line, to provide optimal humidification.

Figure 5:
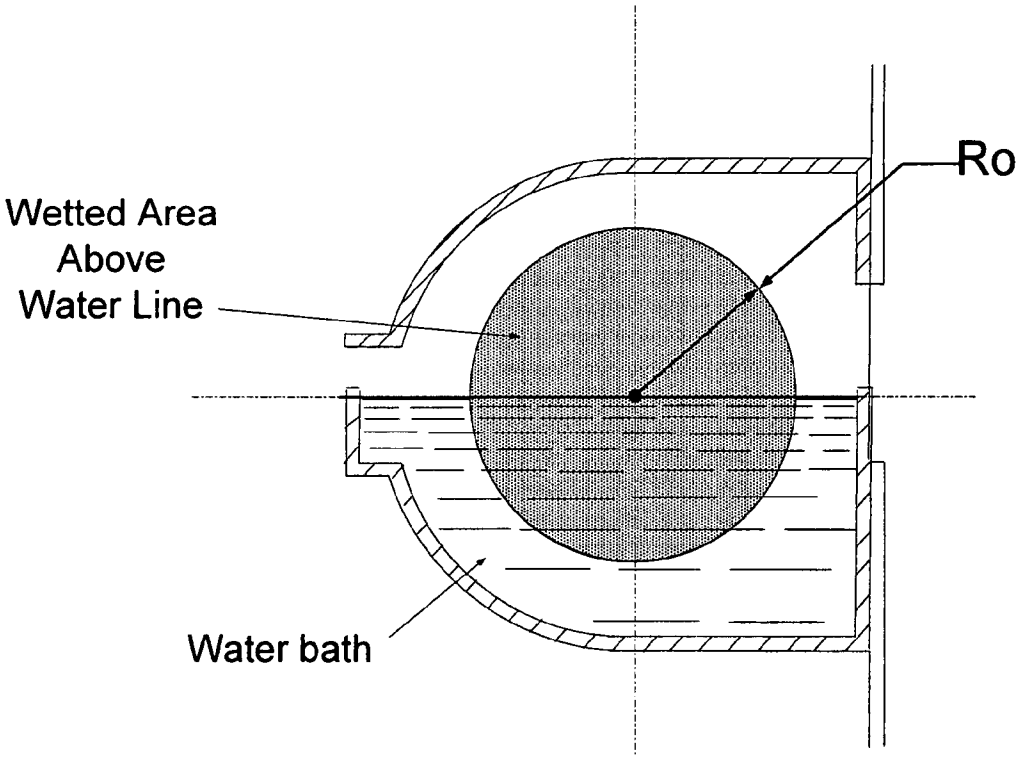
FIG. 5 is a cross section similar to FIG. 4 demonstrating the effects of a water level at the axis rotation of the disk.

The distance from the center of rotation to the water surface can be defined as $R_i$. It can be shown that for a given disk size ($R_o$), the wetted surface area (bounded by $R_o$ and $R_i$), can be optimized by keeping the water level at a certain height with respect to the disk's center of rotation. $R_i$ is also the inner radius, as explained above, of the wetted segment of the disk in FIG. 3. If the water level is at or below the bottom radius of the disk, as shown in FIG. 4, there is no water evaporation from the disk surface. If the water level is even with the disk centerline, as shown in FIG. 5, the wetted area is simply half the disk area, $PiR_o^2/2$, as shown in FIG. 5. If the water level is maintained above the center line of the disk, the wetted area exposed to the air stream is reduced from that shown in FIG. 5. The wetted area exposed to the air stream will then be between $PiR_o^2/2$ and zero.

If the water level is maintained above the bottom edge of the disk, but below the centerline (searching for the optimum area), the wetted area exposed to the air stream can be shown to be equal to the entire area of the disk, minus the area of the disk that is not wetted, minus the wetted area submerged below the waterline (FIG. 3), that is:

$$\begin{array}{lcccc} & \text{Area of Disk} & & \text{Area Not Wetted} & & \text{Area Submerged} \\ A_{wetted\ and\ exposed} = & (PiR_o^2) & - & (PiR_i^2) - PiR_o^2/2 & - & R_iR_o\cos[\sin^{-1}(R_i/R_o)] - R_o^2\sin^{-1}(R_i/R_o), \end{array}$$

where $R_o$=the radius of the disk, and $R_i$=the distance from the disk center to the water surface of the water.

By dividing through by $R_o^2$ and letting $R_i/R_o$=r, this equation becomes $A/R_o^2=Pi(½=r^2)+r\cos(\sin^{-1} r)+\sin^{-1} r$.

Figure 6:
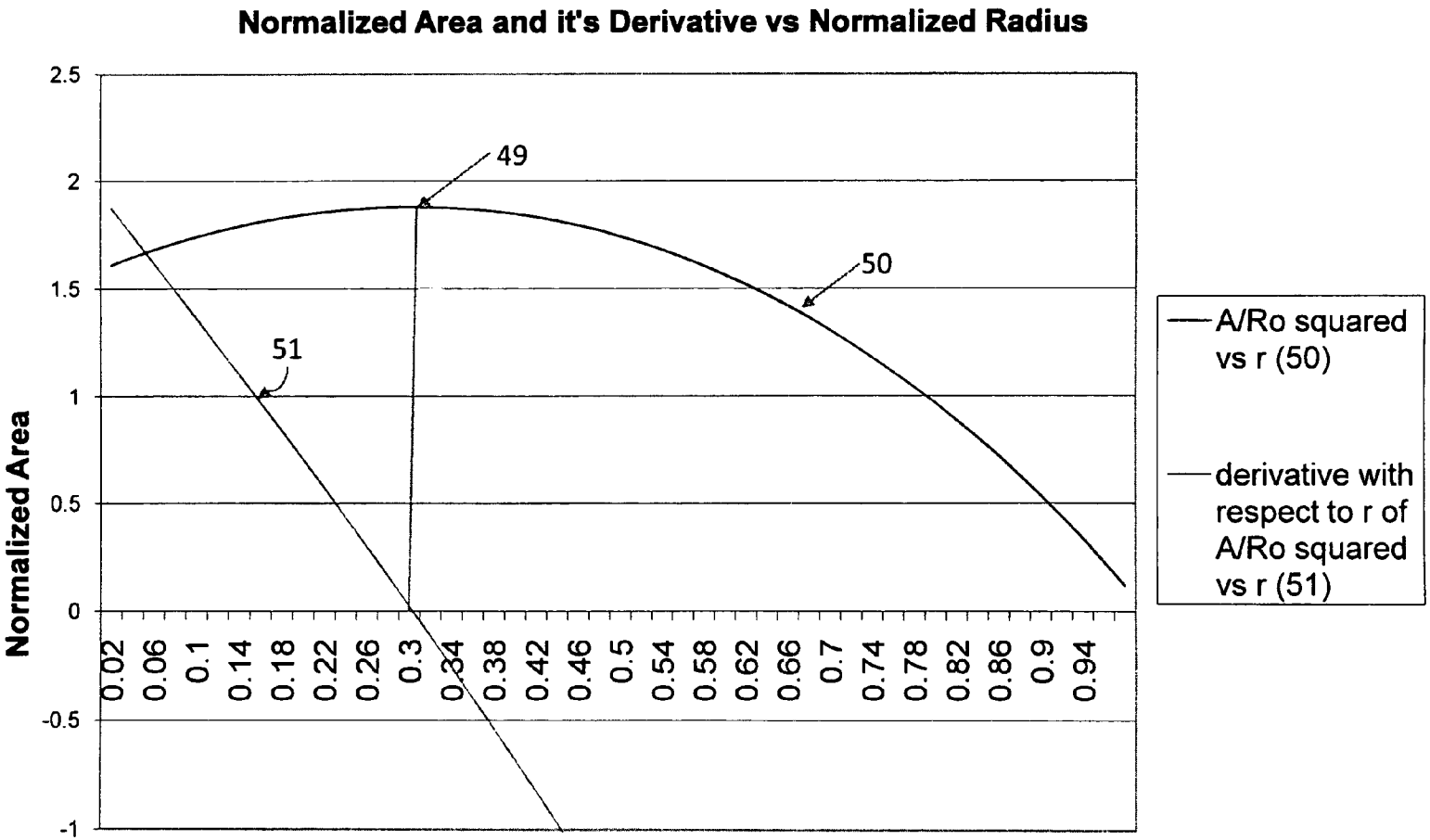
FIG. 6 is a graph illustrating the change in the ratio $R_i/R_o$ to the wetted area of the disks $A_{we}$.

This shows that for any given disk diameter, the wetted area exposed to the air stream $A_{we}$ is a function of the ratio of the inner to the outer diameter. This function does not monotonically increase or decrease between $R_i/R_o$=0 (water line maintained at the center of the disk) and $R_i/R_o$=1/1=1 (water line maintained at the bottom of the disk), and therefore has a maximum wetted area exposed to the air stream. The optimum ratio of the inner to outer diameter is about 0.3, as seen in FIG. 6. This can be shown by solving the above equation numerically (FIG. 6) and corresponds to an optimum wetted area exposed to the air stream about: $A_{max}$ for r=0.3=1.88 $R_o^2$. The maximum $A_{max}$ at r=0.3 can also be found alternatively, by taking the derivative of the normalized area, so $R_i$ should be about 30% of $R_o$.

$$\frac{d}{dr}(A/R_o^2) =$$

$$0 = -2Pi(r) - r\sin(\sin^{-1}r)(1-r^2)^{-1/2} + \cos(\sin^{-1}r) + (1-r^2)^{1/2} = 0$$

This can be shown by setting the above equal to zero, and solving it numerically in FIG. 6. This derivative is simply the slope of the tangent at 49 of curve 50.

Of course, it is not necessary to operate at an $R_i/R_o$ value of exactly 0.30 to achieve the benefits of the present invention, and as used herein the term "substantially 0.30" in reference to the ratio r is in the range of 0.22 to 0.38, and the term "approximately 0.30" is a broader range that could, in certain cases, extend to 0.06 to 0.64, even though this does not represent an optimum range.

The invention claimed is:

1. A rotary disk humidifier that optimizes the wetted area of the disks to improve humidification of the air by selecting a range of disk average outer radius $R_o$ to disk wetted inner radius $R_i$ ratios, namely $R_i/R_o$ comprising:

a humidifier housing having a reservoir for holding liquid, said housing having an air inlet and an air outlet, a plurality of generally parallel disks mounted for rotation in the housing adapted to be partly submerged in the liquid in order to provide a wetted radius , said disks having a center of rotation providing an inner and an outer radius $R_i$ and $R_o$, the ratio of an inner wetted radius of the disks $R_i$ to the outer wetted radius of the disks $R_o$ being in the range of 0.06 to 0.54 in order to provide humidification within 10% of an optimum point on a normalized area vs. normalized radius performance curve as generally depicted in FIG. 6 of the present drawings.

2. A rotary disk humidifier as defined in claim 1, wherein the ratio of $R_i/R_o$ is in range of 0.22 to 0.38.

3. A rotary disk humidifier as defined in claim 1, wherein the ratio of $R_i/R_o$ is approximately 0.30.

4. A rotary disk humidifier as defined in claim 1, wherein the wetted area of the disk exposed to air flowing through the housing is defined by the equation:

$$A_{\text{wetted and exposed}} = \overset{\text{Area of Disk}}{(PiR_O^2)} - \overset{\text{Area Not Wetted}}{(PiR_i^2)} - PiR_o^2/2 - R_i/R_o \overset{\text{Area Submerged}}{\cos}[\sin^{-1}(R_i/R_o)] - R_o^2\sin^{-1}(R_i/R_o).$$

5. A rotary disk humidifier as defined in claim 1, wherein the wetted area of the disk exposed to air flowing through the housing is defined by the equation:

$$A/R_o^2 = Pi(½ - r^2 + r\cos(\sin^{-1} r) + \sin^{-1} r.$$

6. A rotary disk humidifier as defined in claim 1, wherein the inner and outer wetted radius $R_i$ and $R_o$ approximate maximum ratios $R_i/R_o$=approximately 0.30 and is expressed by approximately 1.88 $R_o^2$.

7. A rotary disk humidifier as defined in claim 1, wherein the inner and outer wetted radius $R_i$ and $R_o$ approximate ratio of $R_i/R_o$ of 0.30 is when expressed as a derivative of $R_i/R_o$ versus the ($A_{we}$) wetted area of the disks exposed to air is:

$$\frac{d}{dr}(A/R_o^2) = 0 = -2Pi(r) - r\sin(\sin^{-1}r)(1-r^2)^{-1/2} + \cos(\sin^{-1}r) + (1-r^2)^{1/2} = 0.$$

8. A rotary disk humidifier or dehumidifier assembly comprising: a housing, a plurality of generally parallel disks rotatably mounted in the housing, a reservoir of liquid in the housing, a control for maintaining the liquid level in the housing to optimize the humidification function of the assembly by maintaining the liquid level in the housing at a range of values partially wetting the disks, said control for raising liquid level from the outer diameter of the disks toward the center of the disks so the distance from the center to the liquid level is about 25% to 35% of the distance from the center of the disks to the average outer diameter of the disks.

9. A rotary disk humidifier assembly as defined in claim 8, wherein the liquid level on the disks is $R_i$ and the average outer diameter of the disks is $R_o$, and the ratio $R_i/R_o$ is in the range of 0.22 to 0.38.

10. A rotary disk humidifier assembly as defined in claim 8, wherein the liquid level on the disks is $R_i$ and the outer diameter of the disks is $R_o$, and the ratio of $R_i/R_o$ is in the range of 0.06 to 0.54.

11. A rotary disk humidifier assembly as defined in claim 8, wherein the liquid level on the disks is $R_i$ and the outer diameter of the disks is $R_o$, and the wetted area of the disk exposed to air flowing through the housing is defined by the equation:

$$A_{\text{wetted and exposed}} = (P_iR_o^2) - (PiR_i^2) - PiR_0^2/2 - R_i/R_o \cos[\sin^{-1}(R_i/R_o)] - R_o\sin^{-1}(R_i/R_o).$$

12. A rotary disk humidifier assembly as defined in claim 8, wherein the liquid level on the disks is $R_i$ and the outer diameter of the disks is $R_o$, and the wetted area of the disks exposed to air flowing through the housing is defined by the equation:

$$A/R_o^2 = Pi(½ - r^2 + r\cos(\sin^{-1} r) + \sin^{-1} r.$$

13. A rotary disk humidifier assembly as defined in claim 8, wherein the liquid level on the disks is $R_i$ and the outer diameter of the disks is $R_o$, and the approximate maximum ratio $R_i/R_o$=approximately 0.30 and is expressed by approximately 1.88 $R_o^2$.

14. A rotary disk humidifier assembly as defined in claim 8, wherein the liquid level on the disks is $R_i$ and the outer diameter of the disks is $R_o$, and the approximate ratio of $R_i/R_o$ of 0.30 is when expressed as a derivative of $R_i/R_o$ versus the ($A_{we}$) wetted area of the disks exposed to air is:

$$\frac{d}{dr}(A/R_o^2) = 0 = -2Pi(r) - r\sin(\sin^{-1}r)(1-r^2)^{-1/2} + \cos(\sin^{-1}r) + (1-r^2)^{1/2} = 0.$$

15. A rotary disk humidifier assembly comprising:

a housing;

a plurality of generally parallel disks rotatably mounted in the housing, each disk having an outer diameter edge $R_o$ and an inner diameter edge $R_i$;

a reservoir of liquid in the housing;

an air inlet formed in the housing to provide for airflow within the housing; and a control for maintaining a liquid level to optimize the humidification function of the assembly by maintaining the liquid level in the housing to provide an optimum wetted disk area above the liquid level and exposed to the airflow, the control being positioned on the housing according to an optimization formula for calculating an optimal $R_i/R_o$ ratio.

16. The rotary disk humidifier assembly of claim 15 wherein the control is interoperable with a sensor for raising liquid level from the outer diameter of the disks toward the center of the disks so the distance from the center to the liquid level is about 25% to 35% of the distance from the center of the disks to the average outer diameter of the disks.

17. The rotary disk humidifier assembly of claim 15 wherein the liquid level on the disks is at $R_i$ and the outer diameter of the disks is $R_o$, and the approximate maximum ratio $R_i/R_o$=approximately 0.30 and is expressed by approximately 1.88 $R_o^2$.

18. The rotary disk humidifier assembly of claim 15 wherein the disks are oriented within the housing adjacent the air inlet so that the airflow is directed diametrically across an outer diameter edge $R_o$ toward an inner diameter edge $R_i$ of the disks, wherein the inner diameter edge is adjacent a center point of the disk.

19. The rotary disk humidifier assembly of claim 15 wherein the control maintains a liquid level between a first liquid level and a second liquid level and the assembly includes an upper and lower level sensor and the first liquid level affecting the lower level sensor and the second liquid level affecting the upper level sensor.

20. A rotary disk humidifier assembly comprising:

a housing;

a plurality of generally parallel disks rotatably mounted in the housing, each disk having an outer diameter edge and an inner diameter edge;

a reservoir of liquid in the housing;

an air inlet formed in the housing to provide for airflow within the housing, the disks oriented within the housing adjacent the air inlet so that the airflow is directed diametrically across the outer diameter edge $R_o$ toward the inner diameter edge $R_i$ of the disks, wherein the inner diameter edge is adjacent a center point of the disk; and a sensor unit for optimizing the humidification function of the assembly by maintaining a liquid level in the housing to provide an optimum wetted disk area above the liquid level and exposed to the airflow said sensor for raising liquid level from the outer diameter of the disks toward the center of the disks so the distance from the center to the liquid level is about 25% to 35% of the distance from the center of the disks to the average outer diameter of the disks.

21. The rotary disk humidifier assembly of claim 20 wherein the assembly is included in a furnace air distribution system.

22. The rotary disk humidifier assembly of claim 20 wherein the liquid level on the disks is at $R_i$ and the outer diameter of the disks is $R_o$, and the approximate maximum ratio $R_i/R_o$=approximately 0.30 and is expressed by approximately $1.88\ R_o^2$.

23. The rotary disk humidifier assembly of claim 20 wherein the airflow is directed from the air inlet in a first direction; the disks forming a stack having an axis of rotation and the disk stack oriented within the housing so that the axis of rotation is perpendicular to the first direction of airflow.

24. The rotary disk humidifier assembly of claim 23 wherein the airflow is maintained in a single direction between the air inlet and air outlet while traveling over the disks.

* * * * *